US007316609B2

(12) United States Patent
Dunn et al.

(10) Patent No.: US 7,316,609 B2
(45) **Date of Patent: *Jan. 8, 2008**

(54) REVEAL-HIDE-PICK-REVEAL VIDEO WAGERING GAME FEATURE

(75) Inventors: R. Brooke Dunn, Henderson, NV (US); Josef Alexander Hartl, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 496 days.

This patent is subject to a terminal disclaimer.

(21) Appl. No.: 10/663,440

(22) Filed: Sep. 15, 2003

(65) Prior Publication Data

US 2005/0059459 A1 Mar. 17, 2005

(51) Int. Cl.
*A63F 9/24* (2006.01)

(52) U.S. Cl. ..... 463/16

(58) Field of Classification Search ..... None
See application file for complete search history.

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |
| 5,342,047 | A | 8/1994 | Heidel et al. |
| 5,411,271 | A | 5/1995 | Mirando |
| 5,456,465 | A | 10/1995 | Durham |
| 5,511,781 | A | 4/1996 | Wood et al. |
| 5,524,888 | A | 6/1996 | Heidel |
| 5,536,016 | A | 7/1996 | Thompson |

(Continued)

FOREIGN PATENT DOCUMENTS

EP 0874337 A1 10/1998

(Continued)

OTHER PUBLICATIONS

Addams Family Advertisement and Article written by IGT, Strictly Slots, published in 2000.

(Continued)

*Primary Examiner*—Ronald Laneau
*Assistant Examiner*—Tramar Harper
(74) *Attorney, Agent, or Firm*—Bell, Boyd & Lloyd LLP

(57) ABSTRACT

A game feature, and especially a bonus event game feature for video wagering apparatus has a unique method of displaying at least some of the potential individual rewards or other bonus event results, hiding those potential individual awards or other bonus event results 'beneath' a symbol or region, rearranging a location of the awards, allowing the player to select a symbol or region according to game play methods, and revealing at least the awards or other bonus event results that were underneath selected symbols or areas. Excitement is promoted by having a player anticipate the availability of specific bonus game awards and events during the selection process, as opposed to making selections without any specific knowledge of at least some of the specific bonuses or events that are potentially available in the bonus event.

27 Claims, 6 Drawing Sheets

U.S. PATENT DOCUMENTS 5,542,669 A 8/1996 Charron et al.
5,560,603 A 10/1996 Seelig et al.
5,611,535 A 3/1997 Tiberio
5,711,525 A 1/1998 Breeding
5,769,716 A 6/1998 Saffari et al.
5,772,509 A 6/1998 Weiss
5,775,692 A 7/1998 Watts et al.
5,788,573 A 8/1998 Baerlocher et al.
5,823,874 A 10/1998 Adams
5,833,538 A 11/1998 Weiss
5,848,932 A 12/1998 Adams
5,851,148 A 12/1998 Brune et al.
5,855,514 A 1/1999 Kamille
5,873,781 A 2/1999 Keane
5,882,261 A 3/1999 Adams
5,902,184 A 5/1999 Bennett et al.
5,911,418 A 6/1999 Adams
5,947,820 A 9/1999 Morro et al.
5,951,397 A 9/1999 Dickinson
5,964,463 A 10/1999 Moore, Jr.
5,967,894 A 10/1999 Kinoshita et al.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,015,346 A 1/2000 Bennett
6,019,369 A 2/2000 Nakagawa et al.
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,102,798 A 8/2000 Bennett
6,120,031 A 9/2000 Adams
6,126,541 A 10/2000 Fuchs
6,126,542 A 10/2000 Fier
6,135,884 A 10/2000 Hedrick et al.
6,142,873 A 11/2000 Weiss et al.
6,142,874 A 11/2000 Kodachi et al.
6,142,875 A 11/2000 Kodachi et al.
6,146,273 A 11/2000 Olsen
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 * 1/2001 Walker et al. ..... 463/25
6,179,711 B1 1/2001 Yoseloff
6,190,254 B1 2/2001 Bennett
6,190,255 B1 * 2/2001 Thomas et al. ..... 463/20
6,203,429 B1 3/2001 Demar et al.
6,210,279 B1 4/2001 Dickinson
6,213,876 B1 4/2001 Moore, Jr.
6,224,483 B1 5/2001 Mayeroff
6,231,442 B1 5/2001 Mayeroff
6,231,445 B1 5/2001 Acres
6,261,177 B1 7/2001 Bennett
6,261,178 B1 7/2001 Bennett
6,302,790 B1 10/2001 Brossard
6,305,686 B1 10/2001 Perrie et al.
6,309,300 B1 10/2001 Glavich
6,315,660 B1 11/2001 DeMar et al.
6,315,664 B1 11/2001 Baerlocher et al.
6,319,124 B1 11/2001 Baerlocher et al.
6,328,649 B1 12/2001 Randall et al.
6,375,187 B1 4/2002 Baerlocher
6,398,218 B1 6/2002 Vancura
6,413,160 B1 7/2002 Vancura
6,435,511 B1 8/2002 Vancura et al.
6,439,995 B1 8/2002 Hughs-Baird et al.
6,454,651 B1 9/2002 Yoseloff
6,494,785 B1 12/2002 Gerrard et al.
6,506,118 B1 1/2003 Baerlocher et al.
6,511,375 B1 * 1/2003 Kaminkow ..... 463/20
6,514,141 B1 2/2003 Kaminkow et al.
6,569,015 B1 5/2003 Baerlocher et al.
6,569,016 B1 5/2003 Baerlocher
6,572,471 B1 6/2003 Bennett
6,575,830 B2 * 6/2003 Baerlocher et al. ..... 463/20
6,582,307 B2 6/2003 Webb
6,595,854 B2 7/2003 Hughs-Baird et al.
6,599,185 B1 7/2003 Kaminkow et al.
6,599,192 B1 7/2003 Baerlocher et al.
6,602,136 B1 8/2003 Baerlocher et al.
6,604,999 B2 8/2003 Ainsworth
6,609,974 B2 8/2003 Mead et al.
6,632,141 B2 10/2003 Webb et al.
6,648,754 B2 11/2003 Baerlocher et al.
6,659,864 B2 * 12/2003 McGahn et al. ..... 463/16
6,719,632 B2 4/2004 Palmer et al.
6,722,981 B2 4/2004 Kaminkow et al.
6,722,982 B2 4/2004 Kaminkow et al.
6,758,750 B2 7/2004 Baerlocher et al.
6,786,820 B2 9/2004 Gerrard et al.
6,793,579 B2 9/2004 Baerlocher et al.
6,796,905 B2 9/2004 Baerlocher et al.
6,808,452 B2 10/2004 Baerlocher et al.
6,808,454 B2 10/2004 Gerrard et al.
6,811,483 B1 11/2004 Webb et al.
6,852,030 B2 2/2005 Baerlocher et al.
6,890,257 B2 5/2005 Baerlocher
6,899,623 B2 5/2005 Baerlocher
6,942,566 B2 9/2005 Baerlocher et al.
6,942,567 B2 9/2005 Baerlocher et al.
6,960,132 B2 11/2005 Baerlocher et al.
6,966,833 B2 11/2005 Kaminkow et al.
6,971,953 B2 12/2005 Gerrard et al.
2002/0187827 A1 12/2002 Blankstein
2003/0046343 A1 * 3/2003 Luccesi et al. ..... 463/20
2003/0162584 A1 * 8/2003 Hughs-Baird et al. ..... 463/20
2003/0216167 A1 * 11/2003 Gauselmann ..... 463/25
2004/0038729 A1 2/2004 Webb et al.
2004/0048644 A1 * 3/2004 Gerrard et al. ..... 463/16
2004/0180710 A1 9/2004 Palmer et al.
2004/0185928 A1 9/2004 Baerlocher et al.
2004/0214632 A1 10/2004 Cuddy et al.
2005/0020346 A1 1/2005 Baerlocher
2005/0032567 A1 2/2005 Baerlocher et al.
2005/0037829 A1 2/2005 Baerlocher et al.
2005/0054414 A1 * 3/2005 Gauselmann ..... 463/16
2005/0101375 A1 5/2005 Webb et al.
2005/0130729 A1 6/2005 Baerlocher et al.
2005/0187010 A1 8/2005 Baerlocher
2005/0266914 A1 12/2005 Baerlocher et al.
2006/0003837 A1 1/2006 Baerlocher et al.

FOREIGN PATENT DOCUMENTS

EP 0926645 A2 6/1999
EP 0944030 A2 9/1999
EP 0945837 A2 9/1999
EP 0981119 A2 2/2000
EP 0984408 A2 3/2000
EP 0984409 A2 3/2000
WO WO 9732285 9/1997

WO WO 00/12186 3/2000

OTHER PUBLICATIONS

Adders and Ladders Advertisement written by Barcrest Ltd., published prior to 2000.
American Thunder Screen Shots written by IGT, published in 1998.
Big Bang Piggy Bankin Advertisement written by WMS Gaming, Inc., published prior to 2000.
Blackjack/Twenty-One Description written by Hoyle's Rules of Games, published in 1993.
Bonus Spin Red, White & Blue Advertisement written by IGT, published in 2000.
Bonus Times Article written by Strictly Slots, published in 2000.
By George written by IGT, published in 2002.
Caribbean Gold II Advertisement written by Artistocrat Incorporated, published in 1998.
Cash Box Advertisement & Article written by Anchor Games, Strictly Slots, published in 2000.
Chutes & Ladders Game Instructions written by Hasbro-Milton Bradley, published in 1999.
Description of Let's Make a Deal Television Show written by letsmakeadeal.com (2 pages), printed on Mar. 16, 2001.
Double Diamond Game Descriptions written by IGT printed on Mar. 21, 2001.
Double Up Poker Game Description written by IGT Undated.
Easy Street Advertisements and Articles written by Casino Data Systems, published in 2000.
Elvis Advertisement written by IGT, published in 1999.
Empire Game Advertisement written by AC Coin, published in 1996.
Fire and Fortune Article written by Strictly Slots, published in 2001.
Fox "N" Hound Advertisement written by IGT, published in 2000.
In Between Game Description written by IGT, available prior to 2000.
Jackpot Party Advertisements and Articles written by WMS Gaming, Inc., published in 1998.
Keep Your Hat On Advertisement written by Aristocrat, published in 2001.
Let's Make a Deal written by geocities.com (10 pages), printed on Mar. 21, 2001.
Let's Make a Deal written by fortunecity.com (4 pages), printed on Mar. 21, 2001.
Let's Make a Deal written by Illinoislottery.com (1 page), printed on Mar. 21, 2001.
Let's Make a Deal geocities.com (2 pages), printed on Mar. 16, 2001.
Let's Make A Deal Advertisement written by Shuffle Master and IGT, published in 2001.
Let's Make a Deal Game Advertisement written by Bally Gaming Systems, published in 1999.
Little Green Men Advertisement and Article written by IGT, Strictly Slots, published in 2000.
MegaJackpots Advertisement written by IGT, published in 1998.
Money Grab Article written by Strictly Slots, published in Apr. 2001.
Money in the Bank Advertisement written by Strictly Slots Konami, published in 2001.
Monopoly Advertisements and Articles written by WMS Gaming, Inc., Strictly Slots, published in 1998, 1999, 2000.
Monopoly Party Train Article written by Strictly Slots, published in 2002.
Neon Nights written by IGT, published in 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Article written by Strictly Slots, published in Mar. 2001.
Take Your Pick Advertisement written by IGT/Anchor Gaming, published in 1999.
Texas Tea Advertisement written by IGT, published in 2000.
Top Cat Advertisement written by WMS Gaming, Inc., published prior to 2000.
Top Dollar Game Advertisement written by IGT, published in 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming, Inc., published in 1998.

* cited by examiner

| | PAY LINE 1 | PAY LINE 2 | PAY LINE 3 | PAY LINE 4 | PAY LINE 5 |
|---|---|---|---|---|---|
| | 100 | 200 | 300 | 400 | 1000 |
| | 80 | 80 | 80 | 80 | 80 |
| ANY THREE MIXED | 40 | 40 | 40 | 40 | 40 |
| | 30 | 30 | 30 | 30 | 30 |
| | 20 | 20 | 20 | 20 | 20 |
| | 20 | 20 | 20 | 20 | 20 |
| | 15 | 15 | 15 | 15 | 15 |
| | 10 | 10 | 10 | 10 | 10 |
| | 5 | 5 | 5 | 5 | 5 |
| | 5 | 5 | 5 | 5 | 5 |
| | 2 | 2 | 2 | 2 | 2 |
| | 2 | 2 | 2 | 2 | 2 |

*Fig. 3*

REVEAL-HIDE-PICK-REVEAL VIDEO WAGERING GAME FEATURE

CROSS-REFERENCE TO RELATED APPLICATION

This application is related to the following commonly-owned co-pending patent application: U.S. patent application, Ser. No. 10/086,014 filed on Feb. 28, 2002,

BACKGROUND OF THE INVENTION

1. Field of the Invention

The present invention relates to the field of wagering apparatus, wagering games played on that apparatus, and especially bonus-type game events played on video wagering game apparatus.

2. Background of the Art

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. The trend in video slot play is towards games with better graphics and sound features and that are more entertaining. Operators consequently strive to employ the most entertaining and exciting machines available, because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept which has been successfully employed to enhance the entertainment value of a game is the concept of a "secondary" or "bonus" game which may be played in conjunction with a "basic" game. The bonus game may comprise any type of game, either similar to or completely different from the basic game, which is entered upon the occurrence of a selected event or outcome of the basic game. The bonus game is entered upon the appearance of a special symbol combination on the reels of the slot machine in the basic game. The triggering event is usually a winning event, whose award includes credits and entry into the bonus event. In the bonus game, the probability of winning combinations appearing on the reels, or the "hit rate," is much greater than that of the basic game. The player is permitted to keep playing and accumulating winnings from the bonus game until a losing trial occurs. Such a bonus game produces a significantly higher level of player excitement than the basic game because it provides a greater expectation of winning than the basic game and is accompanied with more attractive or unusual video displays and/or sounds.

Because the bonus game concept offers tremendous advantages in player appeal and excitement relative to other known games, and because such games are attractive to both players and operators, there is a continuing need to develop new types of bonus games to satisfy the demands of players and operators. Preferably, such new bonus games will maintain, or even further enhance, the level of player excitement offered by bonus games heretofore known in the art. Numerous bonus events are already known in the gaming industry and the video wagering game industry in particular.

Yoseloff, U.S. Pat. Nos. 6,179,711 and 6,454,651 describe generic bonus events in which multipliers in excess of 2 can be provided in second screen bonus events.

Bennett, U.S. Pat. No. 6,271,178 discloses that it is normal in machines of the type having multiple pay lines available, that the player purchases the option of playing for a win on lines other than the center line. In order to add further player interest, the game is also provided with a random feature whereby under certain circumstances, a further combination of symbol positions; referred to as the "mystery line", will be randomly selected by the machine's controller to give the player another winning opportunity. A prize is paid to the player in the event that a predetermined combination of symbols is displayed on the "mystery line".

Thomas et al., U.S. Pat. No. 6,190,255 describes a bonus event known in the art as "Pick Until You Pop," in which a number of player selectable symbols are provided on a screen, usually in a bonus mode. The symbols are selected by the player, and then the award behind the symbol is revealed. The bonus event or game event ends when a result behind a symbol is revealed that has the property of ending the bonus whenever that result is revealed. The "end bonus event" is typically a winning event.

Schneider et al., U.S. Pat. No. 6,089,976 describes a gaming apparatus and method including a primary game and a player interactive bonus game actuated by a qualifying outcome of the primary game and including a bonus award display showing a multiplicity of images displayed on a video monitor from which a player selects until achieving a pair of matched bonus awards. The matching of symbols results in a payout. This method of play is referred to in the art as "Pick Until You Match."

Vancura, U.S. Pat. Nos. 6,059,289 and 6,033,307 describe a method for playing a bonus game in a secondary slot machine adjacent a primary slot machine. The primary slot machine issues a bonus qualifying signal to the secondary slot machine to start play of a bonus game when a bonus qualifying event occurs. The reels of the bonus game include value symbols, null symbols, and end game symbols which may be of two basic types: a lose game symbol and a stop game symbol. After the random spin, the values of any value symbols displayed on the pay line of the secondary slot machine are accumulated into an accumulated winning value. The value symbols could include positive integer values, negative integer values, and multiples. The random spinning, determination of values of any value symbol and the accumulation of a winning value is repeatedly continued until an end of the bonus game occurs. The invention provides two adjacent gaming machines. In the preferred embodiment, the gaming machines are slot machines and each slot machine employs physical reels with stops that have equal probabilities of landing on each reel position and wherein each reel has a predetermined number of stops. In the primary slot machine, a bonusing qualifying event is used to enable a player to play the secondary slot machine containing the bonus game. The bonusing game on the secondary machine proceeds in a cumulative fashion with the player stopping when special "lose" or "stop" play symbols appear on the pay line, when the player issues a stop signal, when a predetermined amount of winnings occurs, when a predetermined number of spins occurs, or any combination thereof.

Slomiany et al., U.S. Pat. No. 6,159,098 also describes a bonus game for a gaming machine with two types of awards.

The bonus game includes a plurality of selection elements, a number of which are associated with an award of coin(s) or credit(s) and a number of which are associated with an end-bonus penalty. The game is played by selecting a number of the selection elements, one at a time, until encountering a selection element associated with an end-bonus penalty which ends the bonus game. A first award type in the bonus game is a selection-based award in which the player is credited an amount of coin(s) or credit(s) based on the value (or cumulative value) of the selection elements selected in the bonus game. A second award type in the bonus game is a quantity-based award in which the player is credited an amount of coin(s) or credit(s) based on the number of successful trials of the bonus game.

Baerlocher et al., U.S. Pat. No. 6,315,664 describes a bonus scheme for a gaming device, which presents a plurality of indicators to the player. Each indicator may be a success indicator or a failure indicator based on a pre-determined probability. Upon or prior to the selection of the indicator, the processor in the gaming device determines, based on that probability, if the indicator is a success indicator or a failure indicator. When a player selects an indicator, the gaming device displays if the selected indicator is a failure indicator or a success indicator and a value associated with the success indicator.

The player selects indicators until the player selects all of the success indicators or the player selects a failure indicator. Accordingly, based on chance and the pre-determined probability, a bonus round may include all success indicators and no failure indicators to increase player excitement and enjoyment.

Hughs-Baird et al., U.S. Pat. No. 6,439,995 describes a gaming device having a bonus round with multiple selection groups. The bonus round does not end upon an "end-bonus" selection; rather, the bonus round ends upon the selection of a predetermined number of selections from the last or final selection group. In one embodiment of the present invention, the number of selections is determined from a selection group preceding the final selection group. Prior to determining the number of final selection group picks, the game provides the player with at least one selection group in which the player selects award indicators until selecting an indicator that advances the player to the next selection group. Player excitement and enjoyment is enhanced because the invention provides the player with multiple opportunities to achieve game credits and because the player is guaranteed to have at least one opportunity to select from the final selection group. In one embodiment, the final selection group has larger values than the previous selection groups.

Kaminkow, U.S. Pat. No. 6,511,375 describes a gaming device bonus round that contains a plurality of groups each having a plurality of selections that the player can pick and receive an award. The groups and selections form a theme that provides enjoyment and excitement to the player. The game enables the player to pick a predetermined number of selections from each group. After the player picks from each selection group, the game uncovers, reveals and awards an award hidden underneath and the awards of selections that the player did not choose. The bonus round includes audio and visual displays, in accordance with the game theme, that either direct or follow along with the player's progress of the bonus round. As the player proceeds through the bonus round, the game accumulates the awards and displays the accumulation at the end of the round.

Baerlocher, U.S. Pat. No. 6,569,016 describes a gaming device that contains a plurality of awards each having a value, a plurality of activators, a plurality of deactivators, and a set of indicators from which the activators and deactivators are chosen. The activators, deactivators and indicators are numbers. The controller of the gaming device randomly selects one of the indicators. If the plurality of activators includes the selected indicator, the player receives the value of an award. Conversely, if the plurality of deactivators includes the selected indicator, the player does not receive the value of an award. If the plurality of activators or deactivators is sequential, e.g. 1 through 5, the activator set or deactivator set can include a selected integer, for example 3, or a non-integer, for example 3.5. The implementer of the gaming device may predetermine the activators and deactivators or may add another layer of random generation, whereby the gaming device randomly selects the activators and deactivators from the set of indicators. In either case, the implementer can set the probability of success for each award to be any probability, 0 through 100%.

Baerlocher et al., U.S. Pat. No. 6,575,830 describes a bonus round of gaming device in which the player either wins that which the player does not select or the player selectively replaces one award with another award with the hopes of maximizing an ultimate award. In the embodiment wherein the player wins that which the player does not select, one or more selections are made from the plurality of symbols, and the game provides awards assigned to the unselected choices or symbols. In the replacement embodiment, the game replaces the award of a selected symbol with an alternative type of award. In one example, the awards assigned to the unselected symbols are gaming device credits, while the converted or replaced awards assigned to selected symbols are multipliers. After replacement, the game sums the credits, sums the multipliers and multiplies the credits by the multipliers to produce an ultimate award.

Hughs-Baird et al., U.S. Pat. No. 6,595,854 describes a gaming device having a bonus round with multiple selection groups. The bonus round does not end upon an "end-bonus" selection; rather, the bonus round ends upon the selection of a predetermined number of selections from the last or final selection group. In one embodiment, the number of selections is determined from a selection group preceding the final selection group. Prior to determining the number of final selection group picks, the game provides the player with at least one selection group in which the player selects award indicators until selecting an indicator that advances the player to the next selection group. Player excitement and enjoyment is enhanced because the present invention provides the player with multiple opportunities to achieve game credits and because the player is guaranteed to have at least one opportunity to select from the final selection group. In one embodiment, the final selection group has larger values than the previous selection groups.

Kaminkow et al., U.S. Pat. No. 6,599,185 relates to a method and gaming device having a multiple selection and award distribution bonus scheme. A selection is chosen from a group of selections. The present invention determines awards for distribution to the selection. Once determined, the awards are distributed to the selection and a player is provided with the awards. The present invention preferably utilizes a number of award pools in order to determine the award distribution. This award pool determination is based on, for example, a number of probability tables associated with the award pools.

Baerlocher et al., U.S. Pat. No. 6,602,136 describes a bonus scheme for a gaming device, which involves a symbol marker, which advances along one or more paths. The paths include a plurality of symbols and one or more path change conditions. If a path change condition occurs, the symbol marker moves from one path to a different path. While advancing along certain paths, the player has the opportunity to gain bonus value depending upon which symbol the symbol marker visits. This type of bonus scheme increases player excitement and joy for gaming devices.

Bennett, U.S. Pat. No. 6,572,471 describes a slot machine with a cabinet including a prize display, a coin entry slot, and a payout tray and internally mounted game control processor circuits. The game display comprises a video display screen controlled to display a game image divided into a matrix of elements or player selectable zones. The video screen is preferably of the touch sensitive variety, having an array of touch sensitive areas located on its display surface with one such area associated with each matrix element. The player may select one of the matrix elements by touching the screen within the area of the respective element to be selected, thereby causing the image in the element to change to reveal whether or not a prize value is associated with that zone.

Bally Gaming "Poker Plus" game. This is a video game with a bonus event that has been published since at least about 1984. When a four-of-a-kind hand is achieved, a bonus event is entered. To win the bonus event, specific cards in the four-of-a-kind set of cards must be selected upon command. All cards are initially viewed, the cards are turned face-down and 'shuffled,' the command to select a specific card (both rank and suit are identified), and the player makes a selection by exercise of controls. The proper selection provides a bonus doubling the win on the four-of-a-kind play without risking the award. Each successive request then identifies another card in the set of original four-a-of-a-kind, and the existing awards are again doubled. There is no mention or suggestion of a specific preview of the awards that are possible in the bonus event, but merely identifies the symbols from which a selection is eventually made. The individual symbols do not have a specific relationship to value or awards.

A Carnival wagering game is known as "Three-Card Monte" in which three cards of different identity (e.g., suit and/or rank) are shown to players. The dealer then turns the cards face down, dexterously rearranges the cards, and challenges the player to select a specific card and place a wager on that selection. There is no specific value on the individual cards, but they are displayed to the player prior to the rearrangement.

In spite of the variety of games and bonuses that are presently described in the literature, there is always room for improvement and the addition of features that attract and maintain the interest of players.

SUMMARY OF THE INVENTION

A game feature, and especially a bonus event game feature for video wagering apparatus has a unique method of displaying at least some of the potential individual rewards or other bonus event results, hiding those potential individual awards or other bonus event results 'beneath' a symbol or region, randomly re-arranging the awards allowing the player to select a symbol or region according to game play methods, and revealing at least the awards or other bonus event results that were masked by the selected symbols or areas. Excitement is promoted by having a player anticipate the availability of specific bonus game awards and events during the selection process, as opposed to making selections without any specific knowledge of at least some of the specific bonuses or events that are potentially available in the bonus event.

BRIEF DESCRIPTION OF THE FIGURES

FIG. 3 shows a pay table for a reel-type game.

DETAILED DESCRIPTION OF THE INVENTION

The present invention will be described with respect to a specific game that is a non-limiting example of the type of game that may be played along with the bonus event of the present invention. It is apparent to those skilled in the art that alternative games, alternative systems, alternative awards, alternative bonus events, and other variations may be made within the scope of the present invention. All of the references and prior art described above is incorporated herein by reference in their entirety with respect to apparatus, materials, software, hardware and game play methods that may be used in conjunction with the bonus event of the present invention. Examples of this combination of prior technology with the present invention would be the display of the potential awards (according to the present invention) in combination with Pick Until You Pop bonuses, Pick Until You Match bonuses, picking until selections are exhausted, exchanging picks, discarding picks, and the like. The underlying described herein in conjunction with the play of the bonus event of the invention is themed on the classic comedy group Stan Laurel and Oliver Hardy.

A game feature, and especially a bonus event game feature for video wagering apparatus has a unique method of displaying at least some of the potential individual rewards or other bonus event results, hiding or masking those potential individual awards or other bonus event results 'beneath' a symbol or region re-arranging the rewards or bonus event results, allowing the player to select a symbol or region according to game play methods, and revealing at least the awards or other bonus event results that were underneath selected symbols or areas. Excitement is promoted by having a player anticipate the availability of specific bonus game awards and events during the selection process, as opposed to making selections without any specific knowledge of at least some of the specific bonuses or events that are potentially available in the bonus event.

Technical Background of the "Laurel and Hardy" Video Game (Reveal-Pick-Pop Bonus)

Figure 1:
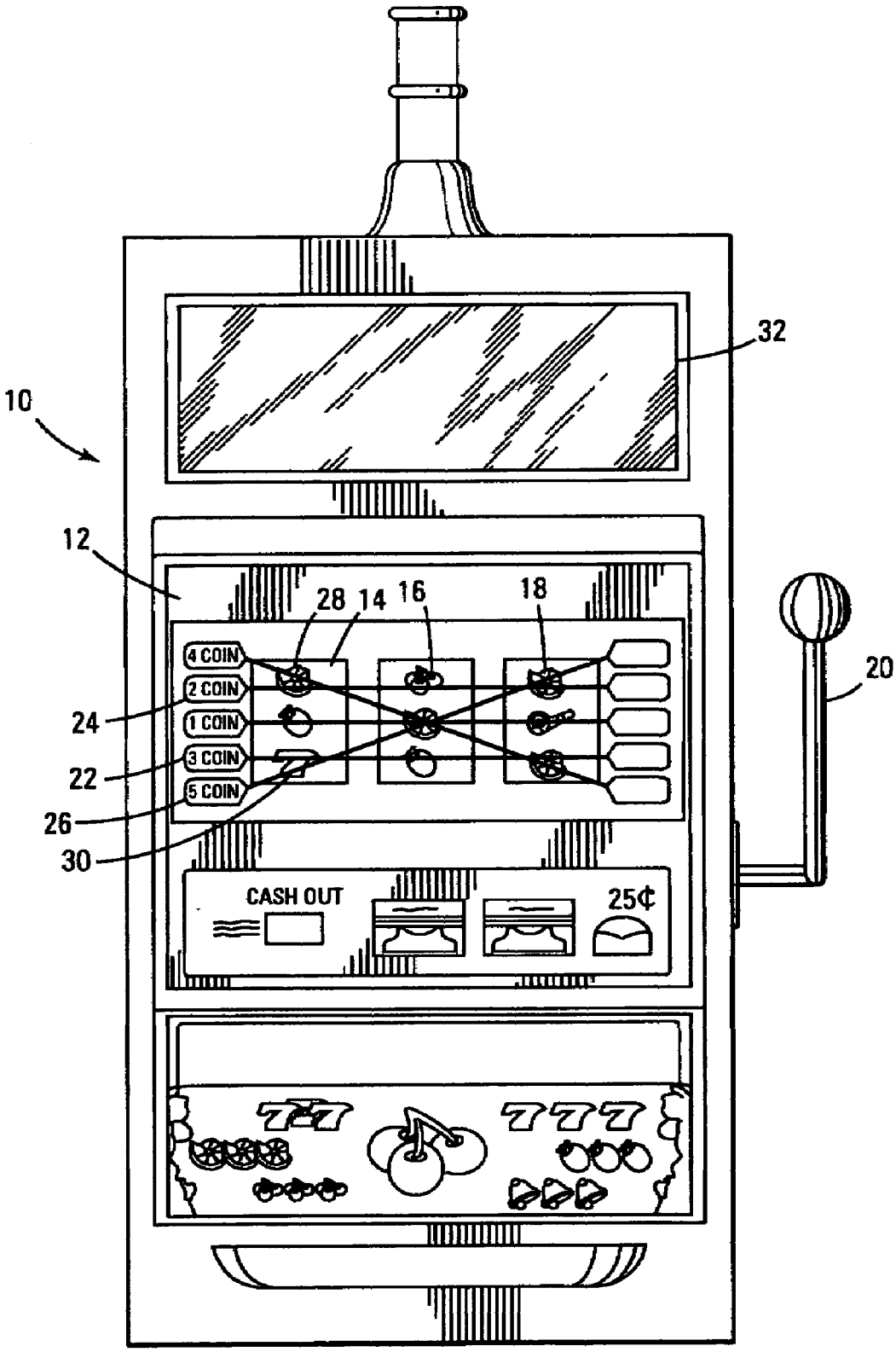
FIG. 1 shows a reel-type gaming apparatus with a bonus display panel.
Figure 2:
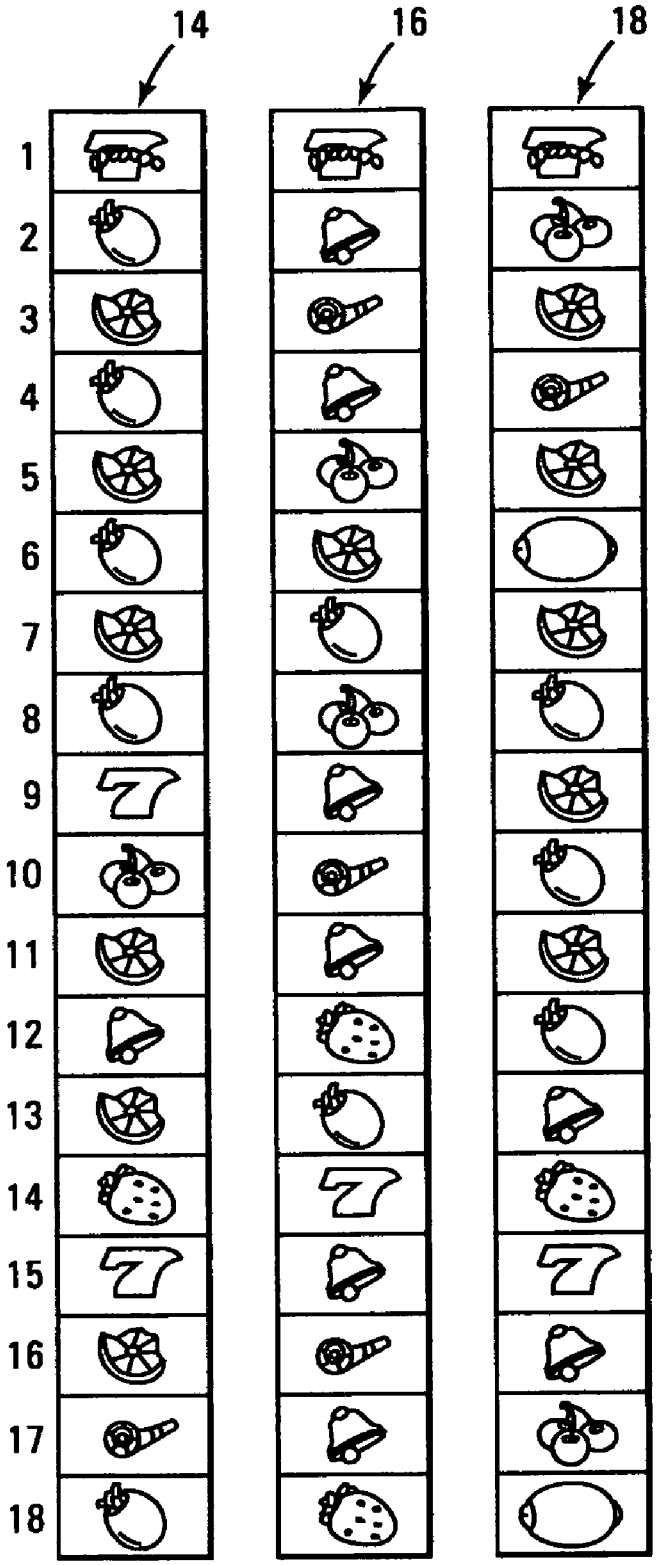
FIG. 2 shows the mapping of reels for a reel-type game.

One preferred format of the "Laurel and Hardy" video game is a 3×5 reel slot-type game that displays a video simulation of three symbols on each reel. Thus yielding a total of fifteen various symbols per play. The game includes one or two optional bonus payouts aside from the basic play. The game could be reformatted as a 1×3, 3×3, 5×5 or other video reel-type game. FIGS. 1 and 2 illustrate a second preferred 3×3 format for the game, using a reel slot machine as the base game and a separate video monitor to display the bonus event.

The Laurel & Hardy game is controlled by both a physical button arrangement on the dashboard of the cabinet and a standard soft button touch screen on the video screen.

However, in another form of the game, the player controls could be located completely on the dashboard, or completely on the display screen.

A status area is located on the lower portion of the game's video screen. The game uses a touch screen to perform the "soft button" functions in one exemplary form of the invention. The help page, credits, line win, total win, play button, pay line selection, bet per line button are part of the dashboard and status area and are controlled by the soft buttons.

Game Symbols & Pay Tables

Laurel & Hardy contains 10 symbols for depicting various winning events for the 3×5 format of the game. Some of the symbols are animated on a win of 3 or more like symbols. It is to be understood that the particular game symbols are unimportant to the play of the game.

PAY TABLE

| Symbol | Pays On | Comments |
|---|---|---|
| Wild | Pays for 5, 4, 3 and 2 like symbols on a pay line | Replaces Laurel symbols, and Hardy symbols |
| Camels | Pays for 5, 4, 3 and 2 like symbols on a pay line | |
| Truck | Pays for 5, 4, 3 and 2 like symbols on a pay line | |
| Crying Laurel | Pays for 5, 4 and 3 like symbols on a pay line | |
| Bowtie Hardy | Pays for 5, 4 and 3 like symbols on a pay line | |
| Laurel Desert | Pays for 5, 4 and 3 like symbols on a pay line | |
| Ollie Desert | Pays for 5, 4, 3 and 2 like symbols on a pay line | |
| Hat Bonus | Scatter Trigger* | Activates a multiplier for 2 hats, activates a separate bonus event for three or more hats |
| Wild | Pays for 5, 4, 3 and 2 like symbols on a pay line | Replaces Laurel symbols, and Hardy symbols |
| Suitcases | Pays for 5, 4, 3 like symbols on a pay line | |

Game Play

Laurel & Hardy play is initiated by the player first establishing a credit base from which to wager on. This credit base is then debited by placing bets on individual games. The player selecting the number of pay lines to activate for the current game. The player can select from one to the maximum number of available pay lines. In one illustrated form of the invention, there are five pay lines. In other forms of the invention, nine or fifteen pay lines. Other numbers of pay lines are contemplated. As the pay lines are selected, each pay line will be graphically displayed on the video monitor. Exemplary pay lines for the 3×3 format game are illustrated below in FIG. 1. A "line trigger" is any triggering event where the symbols have to appear in specific lines or in specific orientations (e.g., in the first three columns in adjacent squares). Once the pay lines are selected, the player selects the number of credits to bet on each pay line. The number of credits bet will be displayed on a balloon at each end of the pay line. To start play, the play button or spin button is activated.

The video reels will animate and appear to spin and then stop in a left to right fashion. A number of symbols are displayed. The game will evaluate any winning combinations or bonuses according to the pay table and game rules. Although not necessary to practice the invention, in one embodiment, winning combinations are paid left to right. As is common with video wagering games. Only pay lines that are selected and bet will be determined to be winners. Pay table values or "odds" for winning combinations are multiplied by the line wager. All payouts are summed to determine the payout.

A winning pay line may be highlighted by framing the winning symbols and the frame will flash. If there is more than one winning pay line, the pay lines will individually flash and cycle one to another. For example if pay line 1, 3 and 5 have winning combinations, line one will highlight and flash individually, then line 3 will flash individually, and finally line 5 will flash individually. At the end of line 5, the cycle repeats with line 1. The status area in the gaming machine cabinet dashboard will display the total win and will also display the line win. This line win is color-coded to the respective pay line that is flashing from step seven above and also displays small icons of the winning symbols.

Bonus Play

Scatter Hat Pay

The following bonus event is described in terms of the video version of the game, in which a 3×5 display is used in the base game. A plurality of "Hat" symbols triggers a scatter pay bonus. Scatter pay is achieved when there are two or more "hat" symbols located anywhere on the play field or display. These symbols can reside in any of the fifteen available symbol locations in a 3×5 symbol game. The scatter bonus payout for two symbols is two times the total amount wagered for the current game. The invention contemplates other odds payouts such as 1×, 5× or higher values. In one example of the invention, three scatter symbols yields 10 times the total amount wagered, four scatter symbols yields 25 times the total amount wagered and five scatter symbols yields 100 times the total bet. The bonus is then added to the player's available credits. This is the traditional use of scatter pay symbols. That is, the symbols appear anywhere and provide a winning event that is dependent upon (a factor of) the amount wagered on the game.

In a preferred form of play, an added bonus of 2× the total amount wagered is paid only for the appearance of two hat symbols anywhere on the screen.

"Derby" Bonus

Laurel & Hardy provides a second screen bonus when the base game play produces a winning combination of symbols. One exemplary combination comprises three to five "Hat" symbols anywhere on the screen. In alternate embodiments, the bonus event is triggered by the appearance of three or more hat symbols on a pay line. After the derby (or hat) bonus is activated, the player is then presented with a second screen which displays a 4×4 matrix of bonus award multipliers, each displayed on a white ball, except for one. An additional award multiplier is presented on a black ball. The black ball represents the "end bonus event" that computes the bonus game and returns the player to the main game.

After all of the multipliers are displayed, the balls are concealed under hats. All balls are multipliers and are initially displayed before bonus play begins, with the balls subsequently hidden behind the hats. The lower portion of the screen contains counters for "Total Bet" and "Credits." On the left side of the screen there is a counter for "Total Award".

The bonus screen initiates an animation that hides the bonus multipliers that were previously revealed, and then randomly mixes the hat locations (as well as the bonus multiplier locations). In another example of the invention, the masking animation remains stationary while the bonus amounts and/or events are randomly moved to new positions. The hats are animated to populate the 4×4 matrix. The player then picks a hat, and the bonus multiplier is then revealed. The bonus multiplier is applied to the current line wager, total amount wagered or payout amounts. The player then continues selecting hats and receiving awards until the player picks a hat that conceals a multiplier that is an "End Bonus" award.

Upon completion of the bonus play, a congratulations screen displays the total bonus award and returns the player to regular game play. The bonus payout in one form of the invention is 2 to 122 times the amount initially wagered for three triggering "Hat" symbols, 2 to 122 times for four triggering "Hat" symbols and 2 to 1000 times for five triggering "Hat" symbols.

The use of a Reveal-Hide-Pick-Display (in this example, a Reveal-Hide-Pick Until You Pop then Display game) is the item of novelty. The novelty acts to create an apprehension or anticipation in the player. This is done by first displaying the possible bonuses for a time sufficient to inform the player of the possible multipliers that can be selected and then allowing the player to pick. A key is that the player does not know where to pick, because the location of the multipliers has been rearranged.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

Turning now to the drawings and referring initially to FIG. 1, there is depicted an electromechanical slot machine 10 which may be utilized to play both a "basic" game and a secondary or "bonus" game. The slot machine 10 includes a display window 12 through which a player may observe three spinning reels, 14, 16 and 18. Game play is initiated by inserting a number of coins or playing a number of credits, causing a CPU or game controller (not shown) to activate a number of pay lines corresponding to the number of coins or credits played. In the illustrated embodiment, up to five pay lines, designated by reference numerals 22, 24, 26, 28 and 30 may be activated, depending on the number of coins or credits played. The play of one coin or credit activates pay line 22, two coins or credits activate pay lines 22 and 24, three coins or credits activate pay lines 22, 24 and 26, four coins or credits activate pay lines 22, 24, 26 and 28 and five coins or credits activate pay lines 22, 24, 26, 28 and 30. It will be appreciated, however, that the present invention may be implemented on machines having fewer or greater numbers of pay lines and/or with pay line(s) which are activated independently of the number of coins or credits played. The present invention may also be implemented with video "reels." Accordingly, the terms "reels," "spinning reels," etc., and the like shall be understood herein to encompass video, as well as mechanical, implementations.

After activation of the pay lines, the reels 14, 16, 18 are set in motion by either pulling a lever 20 or depressing a push button (not shown) on the slot machine 10. The processor then operates according to its game program to select a game outcome (e.g., "basic" game outcome) corresponding to a particular set of reel stop positions and, using technology well known in the art, causes each of the reels 14, 16, 18 to stop at the preselected stop position. Symbols (see FIG. 2) are affixed to the reels 14, 16, 18 to graphically illustrate the reel stop position and indicate whether the stop position of the reels represent a winning game outcome. Winning "basic" game outcomes (e.g., symbol combinations resulting in payment of coins or credits) are identifiable by a pay table affixed to the slot machine 10. A winning combination occurs when the symbols appearing on the reels 14, 16, 18 correspond to one of the winning combinations on the pay table. Traditionally, such winning combinations must be displayed relative to an active one of the pay line(s) 22, 24, 26, 28 and/or 30.

For example, in the illustrated embodiment, if one coin or credit is played, pay line 22 is activated and a winning combination occurs if one of the combinations appearing on the pay table is displayed directly under pay line 22 (e.g., with the first, second and third symbols of the combination being displayed, respectively, in the "left-center" position, "middle-center" position and "right-center" position relative to the display window 12). If two coins or credits are played, pay lines 22 and 24 are activated and winning combination(s) occur if any of the combinations appearing on the pay table are displayed directly under pay line 22 and/or pay line 24. Pay line 24 requires that the first, second and third symbols of the combination are displayed, respectively, in the "left-upper" position, "middle-upper" position and "right-upper" position relative to the display window 12. If three coins or credits are played, pay lines 22, 24 and 26 are activated and winning combination(s) occur if any of the combinations appearing on the pay table are displayed directly under pay lines 22, 24 and/or 26. Pay line 26 requires that the first, second and third symbols of the combination are displayed, respectively, in the "left-lower" position, "middle-lower" position and "right-lower" position relative to the display window 12. If four coins or credits are played, pay lines 22, 24, 26 and 28 are activated and winning combination(s) occur if any of the combinations appearing on the pay table are displayed directly under pay lines 22, 24, 26 and/or 28. Pay line 28 requires that the first, second and third symbols of the combination are displayed, respectively, in the "left-upper" position, "middle-center" position and "right-lower" position relative to the display window 12. Finally, if five coins or credits are played, pay lines 22, 24, 26, 28 and 30 are activated and winning combination(s) occur if any of the combinations appearing on the pay table are displayed directly under pay lines 22, 24, 26, 28 and/or 30. Pay line 30 requires that the first, second and third symbols of the combination are displayed, respectively, in the "left-lower" position, "middle-center" position and "right-upper" position relative to the display window 12.

It will be appreciated, however, that alternative pay schemes may be implemented. For example, a winning combination may be defined by the processor to occur when a special "start-bonus" symbol appears on one or more of the reels in any predetermined display position. In one embodiment of the present invention, a "start-bonus" outcome occurs when a special "start-bonus" symbol appears on each of three reels, in either of three visible display positions (e.g., "upper," "center" or "lower") on each reel, even if such positions do not correspond with an active pay line. The appearance of a "start-bonus" symbol on the designated number of reels, in the designated display position(s) represents a "start-bonus" outcome causing the processor to shift operation from the basic game to a bonus game. In another embodiment, the processor enters the bonus game upon the appearance of a special symbol combination on the reels 14, 16, 18 which is not identified on the pay table. Because such combination is not identified on the pay table, it is a "start-bonus" combination which players will consider to be a losing combination and, accordingly, represents a surprise winning combination to the player. Alternatively or additionally, the occurrence of "start-bonus" symbols and/or combination(s) may cause the processor to award coin(s) or credit(s) in the basic game.

A separate video display 32 is provided for displaying the bonus game, although where the underlying or basic game (e.g., a reel-type slot game) is a video gaming system, both the bonus game and the underlying or basic game may be played on the same display screen. In another preferred form of the game, the base game is a video reel slot simulation and the derby bonus event is displayed on the same video screen. The video display 32 of the first embodiment may comprise a dot matrix, CRT, LED, LCD, electro-luminescent display or generally any type of video display known in the art. In the illustrated embodiment, the video display 32 is vertically disposed within an upper portion of the slot machine 10. It will be appreciated that the "basic" game need not comprise a spinning reel slot machine game, as illustrated in FIG. 1, but may comprise virtually any type of game of chance or skill or combination of such games) having outcomes (e.g., "start-bonus" outcomes) which may trigger play of a bonus game on the video display 32. The basic game may itself be implemented on the video display 32 or a separate video display (not shown). The basic game may comprise a video poker or video blackjack game, for example. In embodiments where both the basic and bonus games are implemented in video, each game may be shown on the same video display.

In one embodiment, the possible basic game outcomes include a special symbol combination (e.g., "bonus-resource" outcome) causing the processor to generate a bonus game resource exercisable in the bonus game. The occurrence of "bonus-resource" outcome(s) may also cause the processor to award coin(s) or credit(s) in the basic game. In one embodiment, the processor continues to operate in the basic mode after the occurrence of a bonus-resource outcome. In this embodiment, any number of bonus-resource outcomes may occur through several repetitions of the basic game (causing the processor to generate a corresponding number of bonus game resources) before entering the bonus mode, if at all, upon the occurrence of a start-bonus outcome. The bonus game resource(s) may comprise any item which operates to enhance the excitement and/or winning expectation in the bonus game. In one embodiment, for example, a bonus game resource is usable to override an otherwise undesired outcome of the bonus game. For example, in a bonus game including one or more "end-bonus" outcome(s) which would otherwise end the bonus game, a bonus game resource, if available, may be used to override the end-bonus outcome and thereby continue play of the bonus game. Another type of bonus game resource might be used as a multiplier (e.g., 2×, 5×, 10×, etc.) of coin(s) or credit(s) awarded in a bonus game. For example, a "5.times." resource played in conjunction with a bonus game outcome awarding 5 coins or credits would result in an award of 25 coins or credits.

FIG. 2 shows a set of reel strips for use with a slot machine of the type shown in FIG. 1 to implement a slot machine game. The reel strips correspond to the reels 14, 16, 18 in FIG. 1 and will be identified by corresponding reference numerals 14, 16, 18. Each of the reel strips 14, 16, 18 includes eighteen symbols, corresponding to eighteen available reel stopping positions. The symbols which appear on reel strip 14 include, in sequence, Jackpot 7, Plum, Orange, Plum, Orange, Plum, Orange, Plum, Blue 7, Cherry, Orange, Bell, Orange, Strawberry, Blue 7, Orange, Party Favor and Plum. The symbols which appear on reel strip 16 include, in sequence, Jackpot 7, Bell, Party Favor, Bell, Cherry, Orange, Plum, Cherry, Bell, Party Favor, Bell, Strawberry, Plum, Blue 7, Bell, Party Favor, Bell and Strawberry. Finally, the symbols which appear on reel strip 18 include, in sequence, Jackpot 7, Cherry, Orange, Party Favor, Orange, Special Lemon, Orange, Plum, Orange, Plum, Orange, Plum, Bell, Strawberry, Blue 7, Bell, Cherry and Lemon.

An exemplary pay table for the slot machine game (corresponding to the symbols shown in FIG. 2) is shown at FIG. 3. The pay table identifies the amount of coin(s) or credit(s) awarded for various combinations of symbols that may appear in the basic game.

The amount of coin(s) or credit(s) identified in the pay table traditionally corresponds to the probabilities of "hitting" the various combinations of symbols, less an appropriate "hold percentage" retained by the slot machine 10.

Where the reels each have eighteen symbols corresponding to eighteen reel stop positions, the odds of "hitting" each unique combination relative to a single active pay line is one in 5,832 (18×18×18). There are numerous ways known in the art to alter this natural hit frequency, including Telnaes, U.S. Pat. No. 4,448,419 and Yoseloff, U.S. Pat. Nos. 6,117,009 and 6,159,096.

A rectangular grid may appear on the display of the bonus game. In one embodiment, the grid consists of thirty frames arranged in five rows and six columns. Each of the tiles comprises a selection element or "window" associated with a particular bonus game outcome. The frames may be initially masked so that the various outcomes corresponding to the windows are hidden "behind" the windows. In one embodiment, the outcomes consist of various numerical outcomes (such as, for example, coin/credit values) and various non-numerical outcomes (such as, for example, "end-bonus" outcomes). The various outcomes according to the invention are displayed, the numerical outcomes masked again, and, optionally for dramatic impact, the masks shuffled or rearranged to provide a visual indication of a random relocation of the numerical and/or other outcomes. The various type(s) of outcomes and the values of the numerical outcomes are predetermined by the game program according to the type of bonus game which is being played (and, in one embodiment, according to the number of coins or credits played) but the placement of the outcomes in the grid (e.g., the determination of which selection elements are to be associated with the various outcomes) is randomly determined by the game controller. Arrangement of the various outcomes, once determined, remains fixed for the duration of the bonus game. The arrangement of outcomes is changed, however, upon subsequent plays of the bonus game so that each individual bonus game will generally have a unique arrangement of outcomes in the grid 40. It will be appreciated that the depiction and arrangement of selection elements, the number(s) of selection elements and the distribution of possible outcomes associated with the selection elements may be varied according to the game program. For example, the selection elements may be depicted as graphical symbols, animations, and the like rather than "windows," and may be provided in fewer or greater numbers than described herein.

As play begins, the player is shown thirty possible outcomes. The outcomes are masked by game elements and the outcomes and/or game elements are repositioned randomly. The player is prompted to select one of the thirty windows, frames or game elements. It will be appreciated that any of several known player control devices may be utilized to implement the selection of window(s). In one embodiment, an animated "hand" pointer scrolls across the grid and window selection is accomplished by the player depressing a designated "select" button when the hand is pointing to a desired selection. Scrolling of the pointer (e.g., hand) prior to the selection of the desired window may be accomplished automatically according to the game program or may be controlled by the player depressing various buttons. In another embodiment utilizing a touch-screen display, the desired window is selected by simply touching the screen in an area over the window. The selection of selection element(s) under player control is a novel concept which enhances the excitement of the bonus game in relation to other types of bonus games known in the art. Whereas other bonus game(s) have outcomes which are determined entirely by the game program, the outcome(s) in the present game are directly influenced by the player's choice(s) of window(s).

Upon selection of a game element, the game controller causes the outcome associated with the selected element to be revealed on the display. Coin(s), spin(s), multipliers or credit(s) are awarded as appropriate, corresponding to the selected outcome. The award of coin(s), spin(s), multipliers or credit(s) may occur immediately upon selection of the outcome or may be deferred until completion of the bonus game.

In one embodiment, when the bonus game has ended, the game program causes the display to reveal the outcomes associated with the entire grid, thereby permitting the player to see which ones of the remaining windows contained end-bonus outcomes and which ones of the windows contained "safe" outcomes such as the award of coin(s), spins, multipliers or credit(s).

In one embodiment, after displaying the entire grid for a few seconds, the game controller causes the display to restore the screen to show only the selected windows, then pays out the win total associated with the selected windows. The win total in the bonus game could be the sum of the selected "coin" symbol awards plus one coin (in a 1-coin game) for the winning symbol. The winning symbol will result in an award 2 coins, 3 coins, 4 coins and 5 coins, respectively, in a 2-coin, 3-coin, 4-coin and 5-coin game. The award of coin(s) for the winning symbol assures a winning outcome in the bonus game even if the winning symbol is the first (and last) selection in the game. After payment of the award, the display screen in one embodiment can display an attract mode animation until the next bonus game is commenced.

The display commands may include packetized graphics instructions which specify, for example, frame animations, sprite animations, text printing and text banners to be displayed by the video display in either a "basic" game or "bonus" game. The display controller executes the video operating instructions to operate the video display.

In one embodiment, the display controller takes the form based on a 68 HC 11 processor and uses a Xilinx 3030 field programmable gate array (FPGA) to provide the logic for an RS-232 interface, an interface to external SRAM 50 and bank switching for program PROM and data PROM(s). The FPGA controls the data flow to the display and provides any required timing signals. Briefly, the FPGA is operatively coupled, as indicated, with the display and also with SRAM, PROM(s) and CPU. An address decoder, flash decoder and page register may be also operatively coupled with the CPU for addressing the PROM.

In one embodiment, the display comprises a dot matrix display having 12,288 elements, including rows of pixels. The pixels are separately actuatable, preferably at a rate of at least a full 32 or 64 frames per second or more, to form a graphics display which may include, for example, animated characters, text or symbols. It will be appreciated, however, that the display may comprise any of several alternative types of displays or modified forms of dot matrix displays. For example, the display may comprise a CRT, LED, LCD or electro-luminescent display rather than a dot matrix display, or may comprise a dot-matrix display having fewer or greater numbers of pixels or a different arrangement of pixels than heretofore described. The display may comprise a color or monochrome display. In an embodiment where the display comprises a monochrome display, the pixels are preferably actuatable at three or more discrete intensity levels to emulate three or more shades of gray.

The display is not limited to showing only the bonus game, but in some embodiments may be used to display both the basic game and bonus game. In other words, the basic game and bonus game may be implemented entirely in video in a gaming machine not having a mechanical spinning reel display. The video game may comprise virtually any type and/or size of video game including, for example, coin operated video games, hand-held video games, microprocessor or PC-driven video games. The video game includes a game controller operably coupled to a memory unit and a graphics display. The memory unit stores control software, operational instructions and data associated with the video game.

In one example of a working embodiment, the memory unit includes a read-only memory (ROM) for storing a game code, graphics and audio associated with the video game and a battery-backed random access memory (RAM) for storing various operating instructions and data for operating the video game. The ROM memory is non-volatile (e.g., its data content is preserved without requiring connection to a power supply) and is generally unalterable while it remains within the video game. The battery-backed RAM memory is volatile but retains its data content as long as power is provided, either from an external power source or the battery back-up. The RAM memory is alterable by the controller when appropriate (e.g., in response to change in operational status of the video game). It will be appreciated that the memory unit may be implemented on memory structures other than ROM and battery-backed RAM, or may be integrated on a single memory structure.

The game controller controls play of the video game responsive to player inputs provided through an operator interface. The game controller may comprise a microcomputer, microprocessor or any other suitable device for executing control of the video wagering game. Either a commercial operating system (e.g., PC-based, MAC, LINUX, UNIX, etc.) or a hardwired unique system may be used. The operator interface may comprise any combination of push buttons, joysticks, keypads, touch-screens and the like. The game controller executes control software in the memory according to the player inputs and communicates the resulting video game activity including, for example, text, animations and background graphics to the graphics display. Either touch screen or a panel of buttons or a keyboard defines an X-Y matrix of selection areas, such as touch responsive points positioned adjacent to and overlying the player selectable symbols of the display. The graphics display may comprise a CRT, LED, LCD, dot-matrix, electro-luminescent display or any other type of display known in the art. The computer systems used are preferably selected from systems described in U.S. patent application Ser. No. 09/405,921 (filed Sep. 24, 1999; titled Video Gaming Apparatus For Wagering With Universal Computerized Controller And I/O Interface For Unique Architecture); Ser. No. 09/520,404 (filed Mar. 8, 2000, titled Encryption in a Secure Computerized Gaming System); Ser. No. 09/949,021 (filed Sep. 7, 2001, titled: Encryption in a Secure Computerized Gaming System); and Ser. No. 10/134,657 (filed Apr. 25, 2002, titled Encryption in a Secure Computerized Gaming System), U.S. Ser. No. 10/134,663 (filed Apr. 25, 2002, titled, Authentication in a Secure Computerized Gaming System); and Ser. No. 10/241,804 (filed Sep. 10, 2002, titled Method for Developing Gaming Programs Compatible With A Computerized Gaming Operating System and Apparatus, each of these references herein incorporated by reference in their entirety for their disclosure on the technical and process construction of gaming apparatus and software.

It will be appreciated, however, that alternative pay schemes may implemented. For example, in one embodiment of the present invention, a winning combination is defined by the game controller to occur when a special "start-bonus" symbol appears on any three consecutive reels in any of the three visible display positions (e.g., "top," "middle" or "bottom"), even though such positions do not correspond with an active pay line. The appearance of three symbols in a scatter pay arrangement, in any relationship on the screen may also initiate the bonus sequence. The appearance of such a combination of "start-bonus" symbols causes the game controller to shift operation from the basic game to a bonus game. In another embodiment, the game controller enters the bonus game upon the appearance of a special symbol combination on three consecutive reels which is not identified on the pay table. Because such combination is not identified on the pay table, it is a "start-bonus" combination which players will consider to be a losing combination and, accordingly, represents a surprise winning combination to the player. Alternatively or additionally, the occurrence of "start-bonus" symbols and/or combination(s) may cause the processor to award coin(s) or credit(s) in the basic game.

The possible basic game outcomes may also include a special symbol combination (e.g., "bonus-resource" outcome) causing the game controller to generate a bonus game resource exercisable in the bonus game. The occurrence of "bonus-resource" outcome(s) may also cause the game controller to award coin(s) or credit(s) in the basic game. In one embodiment, the game controller continues to operate in the basic mode after the occurrence of a bonus-resource outcome. In this embodiment, any number of bonus-resource outcomes may occur through several repetitions of the basic game (causing the game controller to generate a corresponding number of bonus game resources) before entering the bonus mode, if at all, upon the occurrence of a start-bonus outcome. The bonus game resource(s) may comprise any item which operates to enhance the excitement and/or winning expectation in the bonus game. In one embodiment, for example, a bonus game resource is usable to override an otherwise undesired outcome of the bonus game. For example, in a bonus game including one or more "end-bonus" outcome(s) which would otherwise end the bonus game, a bonus game resource, if available, may be used to override the end-bonus outcome and thereby continue play of the bonus game. Another type of bonus game resource might be used as a multiplier (e.g., 2×, 5×, 10×, etc.) of coin(s) or credit(s) awarded in a bonus game. For example, a "5×" resource played in conjunction with a bonus game outcome awarding 5 coins or credits would result in an award of 25 coins or credits.

The video "basic" game also includes various basic game outcomes (e.g., special symbol combinations) which cause the game controller to shift operation from the basic game to a bonus game. The frames or symbols need not be limited to 3×3 or 3×5 symbols, but may be provided in many alternative arrangements. Similarly, pay lines do not have to be linear or extend across all rows or all columns. For example, the video "bonus" game may displayed on a 6×5 rectangular grid consisting of thirty selection elements or "frames," each associated with a particular bonus game outcome. The outcomes consist of various numerical outcomes (such as, for example, coin/credit award amounts) and various non-numerical outcomes (such as, for example, "end-bonus" outcomes, free spins, extra bonus selections, etc.). The various type(s) of outcomes and the values of the numerical outcomes may or may not be predetermined by the game program according to the type of bonus game which is being played (and, in one embodiment, according to the number of coins or credits played) but the placement of the outcomes in the grid (e.g., the determination of which selection elements are to be associated with the various outcomes) is randomly determined by the game controller. Arrangement of the various outcomes, once determined, remains fixed for the duration of the bonus game. The arrangement of outcomes is reaccomplished, however, upon subsequent plays of the bonus game so that each individual bonus game will generally have a unique arrangement of outcomes in the grid.

Upon initial play of the bonus game, the awards are first displayed and then masked to "hide" the various outcomes corresponding to the windows. Before play begins, the awards and/or game symbols are rearranged. In one preferred form of the invention, all game symbols in the bonus game are identical, and all symbols/awards are rearranged. As play begins, the player is prompted to select one of the available windows. In a touch-screen embodiment of the video game, selection of the window is accomplished by the player touching the screen in an area directly over the desired window. Upon selection of a window, the game controller causes the outcome associated with the selected window to be revealed on the display. Unselected windows remain masked so as to continue to "hide" their respective outcomes. Coin(s) or credit(s) are awarded as appropriate, corresponding to the selected outcome.

In an embodiment including "end-bonus" outcomes, the selection of an end-bonus outcome causes the game controller to end the bonus game. In other examples of the invention, the player picks until two or more revealed symbols match, or until the number of picks is expired. Otherwise, the selection of any other outcome causes the controller to prompt the player to make other selection(s), one at a time, until an end-bonus outcome is selected.

In one embodiment, after completion of the bonus game, the game controller causes the potential selection of bonus awards or bonus events to be displayed for a few seconds, then restores the screen to show only the selected frames or screen of the base game. The win total associated with the selected bonus symbols will ordinarily be paid out before the start of the next base game. In one other embodiment, the normalized win amounts associated with the various windows are the same regardless of the number of coins played. Thus, the normalized average bonus also remains the same for any number of coins or credits played. This is in contrast to the embodiment in which the window values differ (and in which the normalized average bonus decreases) in relation to the number of coins played. In the video version, where multiple coins or credits are played, the actual average bonus value is computed by multiplying the normalized average bonus by the number of coins played.

Figure 4:
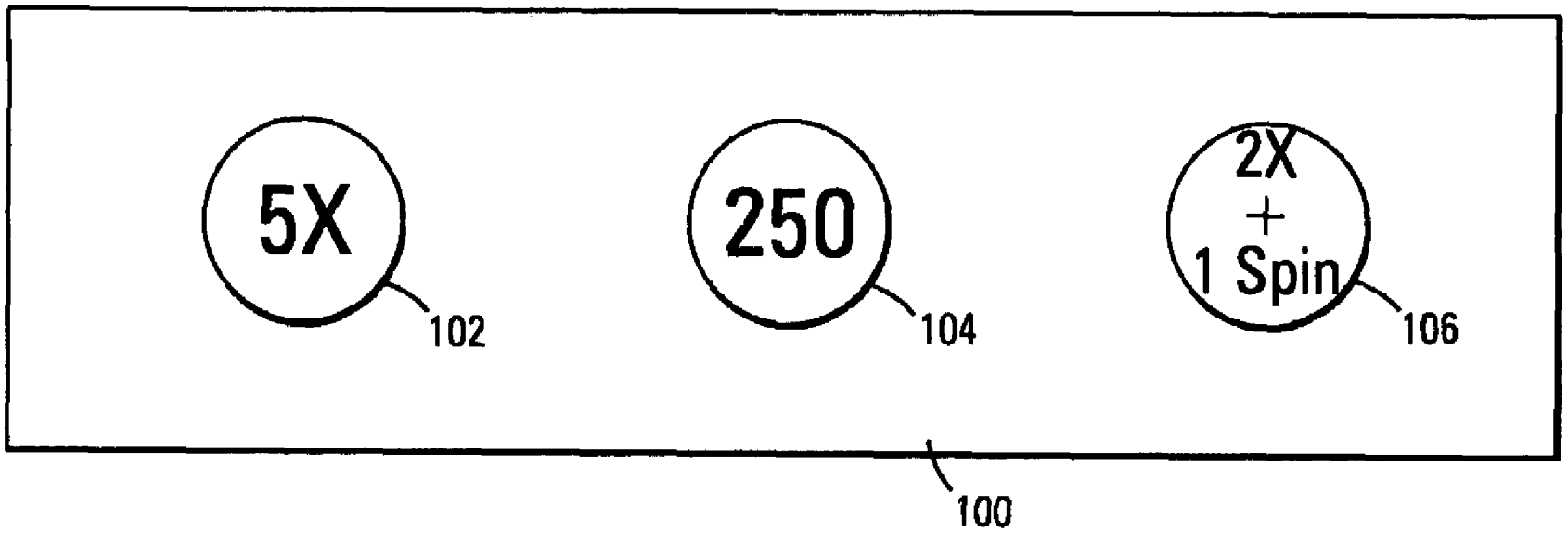
FIG. 4 shows a screen displaying potential bonus awards or events.

FIG. 4 shows a screen 100 displaying potential bonus awards or events 102, 104 and 106.

Figure 5:
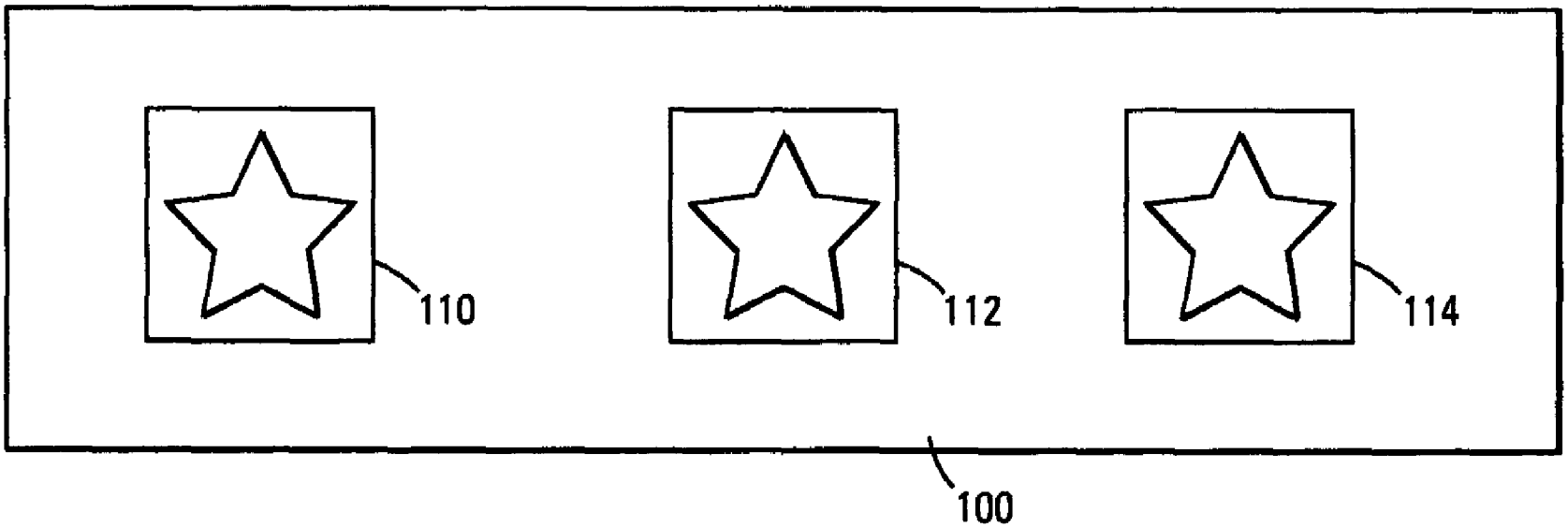
FIG. 5 shows the screen of FIG. 4 after the displayed bonus awards or events are hidden behind symbols.

FIG. 5 shows the screen 100 of FIG. 4 after the displayed bonus awards or events are hidden behind mask symbols 110, 112 and 114.

Figure 6:
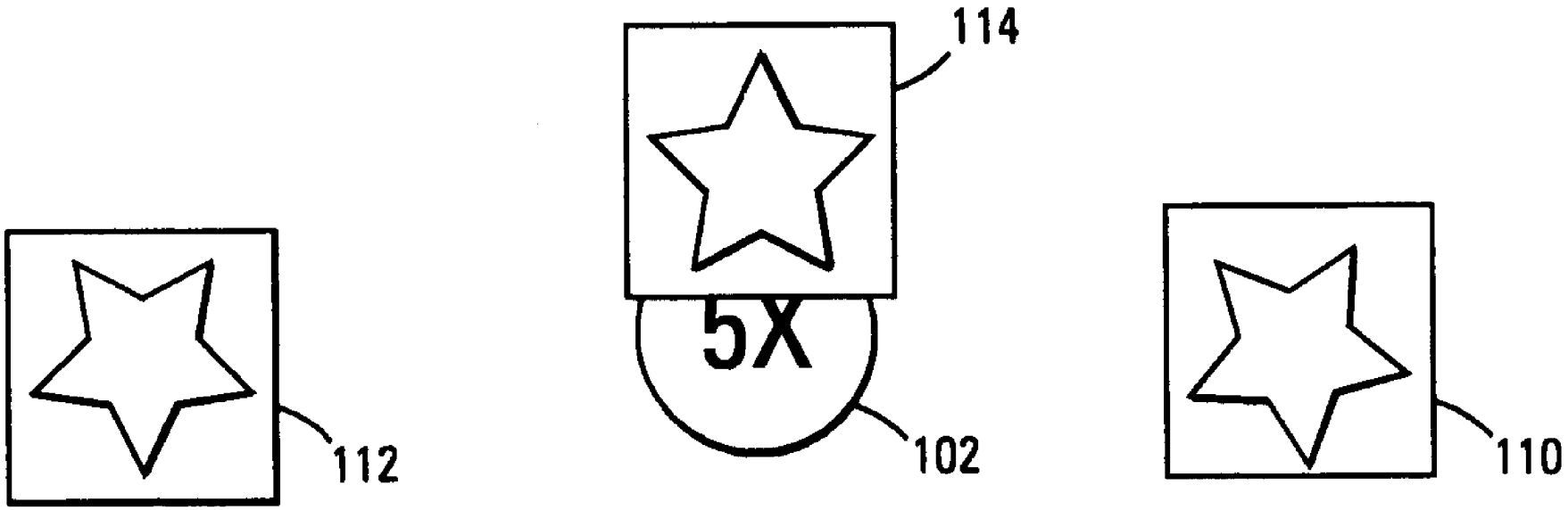
FIG. 6 shows a screen sequence where one selected symbol reveals an underlying bonus award or event after player selection.

FIG. 6 shows a screen sequence where one selected mask symbol 114 partially reveals an underlying bonus award 102 or event after player selection. The mask symbol(s) may be removed to disclose the awards or bonuses by any means. In FIG. 6, the mask symbol 114 is shown to be lifted from the bonus 102. The mask symbol may dissolve, shatter, break apart, segment, walk away, fall, float or otherwise disappear from blocking the view of the bonus award beneath it.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed:

1. A method for operating a gaming device, the method comprising:

(a) receiving a wager for a primary game;

(b) determining a reserve outcome during the primary game;

(c) designating at least one reserved input as a result of an occurrence of the reserve outcome, wherein the designated reserved input is usable in a bonus round;

(d) determining a bonus triggering event during the primary game;

(e) beginning the bonus round after the bonus triggering event is determined;

(f) enabling a previewing of a plurality of possible -bonus outcomes available in the bonus round;

(g) masking the previewed possible bonus outcomes behind a group of selections, wherein at east one of the selections is associated with an end-bonus condition;

(h) rearranging at least some of the selections together with the bonus outcomes masked by said selections, the rearrangement occurring after said bonus outcomes are masked;

(i) enabling a picking of at least one of the selections from the group of selections;

(j) unmasking the bonus outcome masked by the picked selection;

(k) repeating at least steps (i) and (j) for a subsequent pick of one or more of the selections during the bonus round, (l) repeating at least step (k) until the end-bonus condition is satisfied by a picking of the at least one selection associated with the end-bonus condition;

(m) if any designated reserved input is received, overriding the end-bonus bonus condition by repeating at least step (k);

(n) if no reserved input is designated, ending the bonus round after the selection associated with the end-bonus condition is picked; and (o) providing an award based on the one or more unmasked bonus outcomes which are associated with the selections picked.

2. The method of claim 1 wherein the provision of the award includes an end-bonus event.

3. The method of claim 1 wherein at least one of the possible bonus outcomes is selected from the group consisting of an end bonus events, a multipliers, a free-spins, an identified physical prizes and a value awards.

4. The method of claim 1 wherein the bonus round ends after all of the selections in the group have been picked.

5. The method of claim 1 wherein the bonus round ends after: (a) at least two of the selections match; or (b) at least two of the unmasked bonus outcomes match.

6. The method of claim 1 which includes revealing an end-bonus indicator after the selection associated with the end-bonus condition is picked.

7. A gaming machine comprising:

a display device;

a memory device; and a processor operatively coupled to the display device and the memory device, the processor being programmed to:

(a) control a game in a basic mode and a bonus mode, (b) operate in the basic mode to select basic game outcome from among a plurality of possible basic game outcomes, the possible basic game outcomes including:

(i) a reserve outcome, the processor designating at least one reserve input as a result of an occurrence of the reserve outcome; and (ii) a start-bonus outcome, a selection of the start-bonus outcome causing the processor to shift operation from the basic mode to the bonus mode, (c) operate in the bonus mode by providing a plurality of player-selectable bonus game outcomes, the bonus game outcomes including at least one value-associated outcome, (d) enabling a previewing of a plurality of the bonus game outcomes available in the bonus mode;

(e) masking the previewed bonus outcomes behind a group of selections, wherein at least one of the selections is associated with an end-bonus condition;

(f) rearranging a plurality of the selections together with the bonus game outcomes masked said selections, rearrangement occurring after said bonus game outcomes are masked;

(g) enabling a picking of at least one of the selections from the group of selections;

(h) unmasking the bonus game outcome masked by the at least one picked selection;

(i) repeating at least steps (g) and (h) for a subsequent pick of at least one more of the selections during the bonus mode;

(j) repeating at least step (i) until the end-bonus condition is satisfied by a picking of the at least one selection associated with the end-bonus condition;

(k) if any designated reserved input is receive, overriding the end-bonus bonus condition by repeating at least step (i);

(l) if no reserved input is designated, ending the bonus round after the selection associated with the end-bonus condition is picked; and (m) providing an award based on any of the value-associated outcomes which are associated with an of the selections picked.

8. The gaming machine of claim 7, wherein the bonus game ends after at least one pair of selectable bonus outcomes match.

9. The gaming machine of claim 7, wherein the selectable bonus outcomes include a plurality of value-associated outcomes and one or more end-bonus outcomes, a selection of one of the end-bonus outcomes causing the processor to shift operation from the bonus mode to the basic mode, the end-bonus outcomes being distinct from the value-associated outcomes, said selection of said end-bonus bonus outcome ending the bonus game.

10. The gaming machine of claim 7, wherein the bonus game ends after a player has replaced at least one selected bonus outcome.

11. The gaming machine of claim 7, which includes a basic game associated with the basic mode, the basic game comprising a slot game having a spinning reel display showing a number of symbols on one or more reels, the possible basic game outcomes defining various possible combinations of said symbols on said reels one of the combinations defining a start-bonus outcome, the occurrence of which causes the processor to shift operation from the basic mode to the bonus mode.

12. The gaming machine of claim 11, wherein the start-bonus outcome includes a display of a designated start-bonus game symbol on one or more of the reels.

13. A gaming machine comprising:

a plurality of computer-readable instructions; and a processor operable to controll a play of at least one game in a basic mode and a bonus mode, the processor operable to:

(a) execute a plurality of the computer-readable instructions to select a basic game outcome from among a plurality of possible basic game outcomes, the possible basic game outcomes including a start-bonus outcome and a reserve outcome, an occurrence of the start-bonus outcome causing the processor to shift operation from the basic mode to the bonus mode, the processor designating at least one reserved input as a result of an occurrence of the reserve outcome, and (b) execute a plurality of the computer-readable instructions to operate the bonus mode by:

(i) defining a plurality of player-selectable bonus game outcomes, at least one of the bonus game outcomes being associated with an end-bonus condition, (ii) indicating the bonus game outcomes to a player, a plurality of the indicated bonus outcomes being associated with a plurality of values, (iii) masking the indicated bonus game outcomes, (iv) rearranging a location of the masked bonus game outcomes, (v) enabling a player to select one or more of the bonus game outcomes until the bonus game outcome associated with the end-bonus condition is selected, if any designated reserved input is received, overriding the end-bonus condition by repeating at least step (v), (vii) if no reserved input is designated, ending the bonus round after the selection associated with the end-bonus condition is picked, and (viii) providing an award based on the selection, if any, of at least one of the bonus came outcomes which is associated with at least one of the values.

14. The gaming machine of claim 13 wherein the player selectable bonus outcomes include a plurality of value-associated outcomes and a plurality of bonus game outcomes which are associated with a plurality of end-bonus conditions, the selection of one of said bonus game outcomes causing the processor to shift operation from the bonus mode to the basic mode, said bonus game outcomes being distinct from the value-associated outcomes.

15. The gaming machine of claim 13 which includes a bonus end condition associated with a match of at least one pair of player selected bonus game outcomes.

16. The gaming machine of claim 13 which includes a bonus end condition associated with a replacement of at least one player selected bonus game outcome.

17. The gaming machine Claim 13 further comprising a display, the display being operable, in response to instructions from the processor, to mask the bonus game outcomes upon set-up of the bonus mode and reveal the selected bonus game outcomes during play of the bonus mode.

18. The gaming machine of claim 13 further comprising a display, the display being operable, in response to instructions from the processor, to reveal each of the bonus game outcomes in response to the selection of the bonus game outcome associated with the end-bonus condition.

19. The gaming machine of claim 13 wherein the basic mode comprises a slot machine having a spinning reel display for showing a number of symbols on one or more reels, the possible basic game outcomes defining various possible combinations of said symbols on said reels, one of the combinations defining the start-bonus outcome, an occurrence of which causes the processor to shift operation from the basic mode to the bonus mode.

20. The gaming machine of claim 19 wherein the start-bonus outcome is characterized by a display of a designated start-bonus game symbol on one or more of the reels.

21. The gaming machine of claim 13 further including means for awarding credits in response to the selection of the bonus game outcome associated with the end-bonus condition.

22. The gaming machine of claim 21 wherein the means for awarding credits is operable to award credits equal to at least a sum of the values associated with the selected bonus game outcomes.

23. A method for operating a gaming device, the method comprising:

providing an opportunity to play a game operable upon a wager, the game being operable to have a basic mode and a bonus mode;

selecting under control of a processor in said basic mode, a basic name outcome from among a plurality of possible basic game outcomes, the possible basic game outcomes including a start-bonus outcome and a reserve outcome, the processor designating at least one reserved input as a result of an occurrence of the reserve outcome;

shifting operation of the processor from the basic mode to the bonus mode in response to a selection of the start-bonus outcome, otherwise, continuing operation in the basic mode;

setting up, under control of the processor, the bonus mode by defining a plurality of bonus game outcomes, wherein at least one of the bonus game outcomes is associated with an end-bonus condition;

indicating the bonus mode outcomes;

masking the bonus game outcomes, the bonus game outcomes corresponding to a plurality of value-associated outcomes;

rearranging a location of the bonus game outcomes after masking the bonus game outcomes;

enabling selection, under player control, of one or more of the bonus game outcomes during the play of the same in the bonus mode;

removing the masking of each one of the selected bonus-game outcomes; and enabling a player to provide any reserved input which has been designated by the processor;

if the player provides the designated reserved input, overriding the selection associated with the end-bonus condition by repeating the enabling selection step at least once;

if no reserved input is designated, ending the bonus round after the selection associated with the end-bonus condition is picked; and awarding at least one credit for each value-associated outcome which corresponds to one of the selected bonus game outcomes.

24. The method of claim 23 wherein the bonus game outcomes include a plurality of bonus game outcomes which are associated with a plurality of end-bonus conditions, said bonus game outcomes being distinct from the plurality of value-associated outcomes.

25. A gaming system comprising:

a device;

a memory device;

at least one input device; and at least one processor operatively coupled to display device, the memory device and the input device, the processor being programmed to:

(a) receive a wager for a primary game;

(b) start the primary game;

(c) determine an occurrence of a reserve outcome during the primary game;

(d) designate a reserved input as a result of the occurrence of the reserve outcome;

(e) determine an occurrence of a bonus start outcome during the primary game;

(f) start a bonus game;

(g) cause the display device to indicate a plurality of bonus outcome, the bonus outcomes including at least one value and at least one bonus end condition;

(h) cause the display device to display a plurality of symbols so that each one of the symbols is movable in association with one of the bonus outcomes;

(i) cause the display device to display a masking by the associated symbols of the indicated bonus outcomes;

(j) cause the display device to display a rearrangement of a plurality of the symbols;

(k) enable picking of one or more of the symbols until the bonus outcome associated with the bonus end condition occurs;

(l) if any designated reserved input is received, override the end bonus condition after the symbol associated with the end bonus condition is picked;

(m) if no reserved input is designated, end the bonus game after the symbol associated with the end bonus condition is picked; and (n) provide an award based on the value, if any, which is associated with any of the picked symbols.

26. The gaming system of claim 25, wherein the memory device stores at least one instruction executable by he processor to automatically meat step (h) through (l) until step (m) occurs.

27. The gaming system of claim 25, wherein each of said symbols is displayed, then masked prior to being selected by a player and is then revealed in response to being selected by the player.

* * * * *